US005632086A

United States Patent [19]

Helwig

[11] Patent Number: 5,632,086

[45] Date of Patent: May 27, 1997

[54] JEWELRY WIRE BENDER

[76] Inventor: Gary L. Helwig, 20213 Sweet Meadow La., Laytonsville, Md. 20882

[21] Appl. No.: 521,368

[22] Filed: Aug. 31, 1995

[51] Int. Cl.[6] ..... B21L 13/00

[52] U.S. Cl. ..... 29/896.43; 72/457; 140/92.1; 140/123; 140/124; 59/35.1

[58] Field of Search ..... 140/92.1, 102.5, 140/106, 124, 123; 72/457, 477, 458, 371; 29/896.411, 896.42, 896.43; 59/35.1, 20

[56] References Cited

U.S. PATENT DOCUMENTS

| | | | |
|---|---|---|---|
| 1,042,112 | 10/1912 | Hartman . | |
| 1,114,384 | 10/1914 | Prime . | |
| 2,530,576 | 11/1950 | Gregory | 140/124 |
| 2,907,368 | 10/1959 | Barnes | 140/124 |
| 3,208,239 | 9/1965 | Pintarelli | 29/896.42 |
| 4,049,025 | 9/1977 | Gillingwater | 140/102.5 |
| 4,292,834 | 10/1981 | Tishler et al. | 140/92.1 |
| 4,421,145 | 12/1983 | Broberg, Jr. | 140/123 |
| 4,423,757 | 1/1984 | Broberg, Jr. | 140/123 |
| 4,444,228 | 4/1984 | Demirjian | 140/123 |

FOREIGN PATENT DOCUMENTS

| | | | |
|---|---|---|---|
| 369637 | 1/1907 | France | 72/457 |
| 206252 | 11/1959 | Germany . | |
| 2076714 | 12/1981 | United Kingdom | 140/92.1 |

*Primary Examiner*—David Jones
*Attorney, Agent, or Firm*—Patent & Trademark Services; Joseph H. McGlynn

[57] ABSTRACT

A wire bending jig kit for making attachments used in jewelry making has a plate with four pins positioned on the plate in a cross pattern. Jewelry wire will be bent around the pins in a specific sequence to produce various types of articles, such as clasps and coils used in the making of jewelry. The kit also contains a bar having an aperture near one end which will be used, by itself to form one of the connectors, and will also be used with the plate to help form other connectors.

13 Claims, 2 Drawing Sheets

FIG. 1
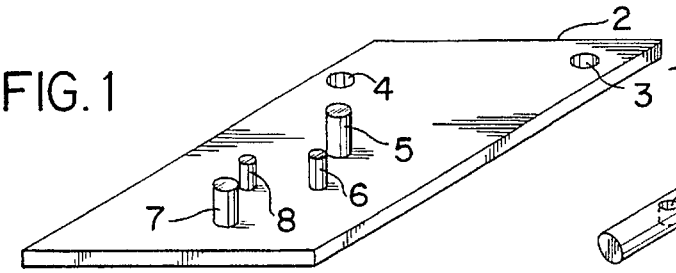
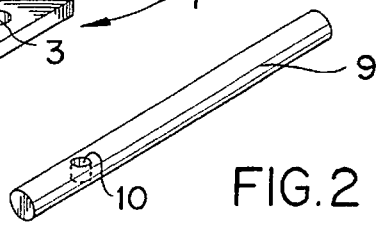
FIG. 2
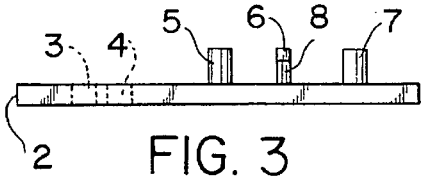
FIG. 3
FIG. 4
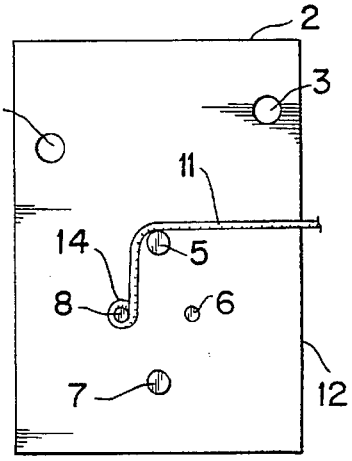
FIG. 5
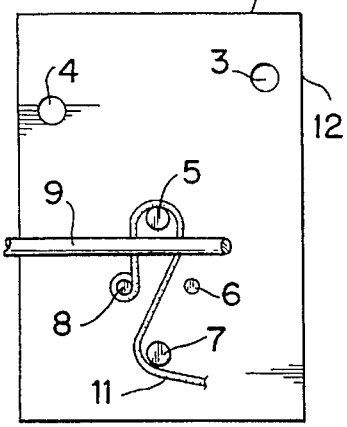
FIG. 6
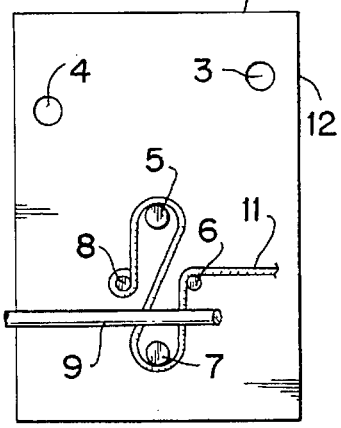
FIG. 7
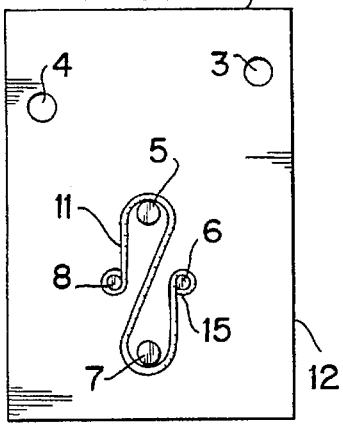
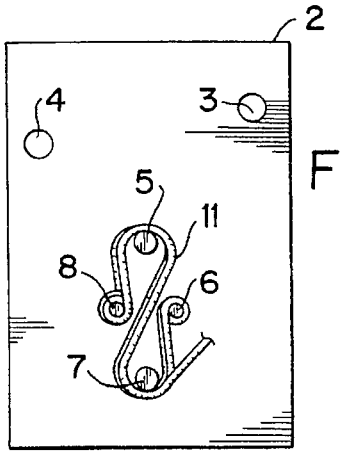
FIG. 8
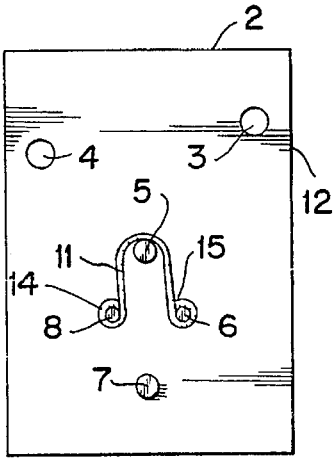
FIG. 9

JEWELRY WIRE BENDER

BACKGROUND OF THE INVENTION

This invention relates in general to wire benders and in particular to wire benders for jewelry making.

DESCRIPTION OF THE PRIOR ART

In the prior art various types of wire benders have been proposed. For example U.S. Pat. No. 1,402,112 discloses a bending apparatus for concrete reinforcing bars having a plate, a plurality of pins positioned in apertures in the plate and a lever arm for bending reinforcing bars around the pins. U.S. Pat. No. 1,114,384 discloses an apparatus for forming articles from metal comprising a plurality of pins arranged in a pattern on a base, and the metal is formed around the pins to makes an article in the shape of the pattern. U.S. Pat. No. 4,4049,025 discloses a wire bender for forming a wire stand for an easel type frame consisting of a plurality of knobs positioned on a base and the wire is formed around the knobs to form an easel type stand. German Patent No. 206,252 disclose a bending tool having a base with two rows of apertures and a lever with a pair of pins that engage in selected apertures to bend wire. Although various types of wire bending apparatus have been disclosed in the prior art, none of the disclosed apparatus have been designed to facilitate the bending of fine wire used in hand production of attachments for making jewelry.

SUMMARY OF THE INVENTION

The present invention relates to producing various types of attachments used in producing hand made jewelry. It consists of a kit containing a plate with four pins positioned on the plate in a cross pattern. Jewelry wire will be bent around the pins in a specific sequence to produce various types of articles, such as decorative components, clasps and coils used in the making of jewelry. The kit also contains a bar having an aperture near one end which will be used by itself to form one of the connectors, and will also be used with the plate to help form other connectors.

Until now making attachments from wire, used in hand made jewelry, had to be done by hand with tools such as needle nose pliers to bend the wire into the desired shape. This was not only time consuming, it was also prone to many errors since each piece had to be formed by guess work. Often the piece was not the correct size for the piece of jewelry and had to be reformed or remade from scratch. Especially for newcomers in this type of craft, this type of operation was difficult since the process was dependent on the "skill" of the person making the article. However, even those with experience found it difficult and time consuming to make the same piece again, since the wire being used is very fine and taking actual measurements was difficult.

Therefore, the jewelry maker often made bends where they "looked" right. If the person was experienced and skilled, the piece might turn out correctly sized. However, if the person was not so experienced or skilled, the piece often turned out the wrong size or improperly shaped. This meant it had to be either reformed or remade from the beginning.

The jig kit of the present invention eliminates the guess work for the experienced person and eliminates the mystery often discovered by the newcomer to the craft. With the use of the jig kit of the present invention a person merely has to follow the proper sequence and each piece turns out properly formed and properly sized.

It is an object of the present invention to produce a jig kit for assisting in bending wire in the hand made jewelry craft.

It is an object of the present invention to produce a jig kit that is inexpensive.

It is an object of the present invention to produce a jig kit for assisting in bending wire which eliminates possible errors in making attachments for hand made jewelry.

These and other objects and advantages of the present invention will be fully apparent from the following description, when taken in connection with the annexed drawings.

BRIEF DESCRIPTION OF THE DRAWINGS

FIG. 1 is a perspective view of the bending jig of the present invention.

FIG. 2 is a perspective view of the holding bar of the present invention.

FIG. 3 is a side view of the bending jig of the present invention.

FIGS. 4–7 are sequential views of the steps used in making a jewelry component with the bending jig of the present invention.

FIG. 8 is a top view of the bending jig of the present invention being used to form another jewelry component.

FIG. 9 is a top view of the bending jig of the present invention being used to form a third type of jewelry component.

DESCRIPTION OF THE PREFERRED EMBODIMENT

Figure 10:
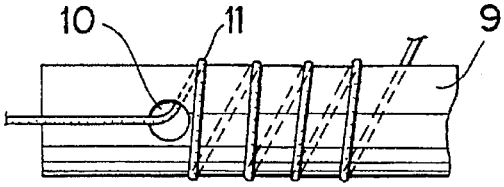
FIG. 10 is a top view of the holding bar of the present invention being used to form a coil connector.

Referring now to the drawings in greater detail, FIG. 1 shows the wire bending jig 1 of the present invention. The jig consists of a flat plate 2 which has a pair of apertures 3 and 4 which can be used to stabilize the plate 2 on a work surface (not shown), for example, by screwing the plate to the work surface. The apertures should be offset so one is near the right side of the plate 2 and the other is nearer the other side of the plate, in order to prevent the plate from turning as the wire is passed around the pins 5, 6, 7, and 8, as will be explained below. However, this positioning is not essential to the use of the jig, and other positions for the apertures 3 and 4 can be selected without departing from the scope of the invention.

At the opposite end of the plate 2, from the apertures 3 and 4, are four pins 5, 6, 7, and 8, spaced approximately 90° apart, which are used as bending or holding points for the wire 11. The pins are placed on an imaginary ellipse with pin 5 at the 0° position, pin 6 at 90°, pin 7 at 180°, and pin 8 at 270°. The pins 5 and 7 are larger in diameter than the pins 6 and 8, as shown in FIG. 3. The pins 6 and 8 will be used to hold the wire only and, therefore they will not have to be as large as pins 5 and 7. By making the pins 6 and 8 smaller more space will be provided to maneuver the wire and the holding bar 9, as will be explained below. Also, the pin 8 is shorter than pin 6, as shown in FIG. 3. This will make it easier to maneuver the wire as it is passed over and around the pins while making the various jewelry components. Since pin 8 is shorter than pin 6, the wire can be passed over the top of pin 8 without lifting the wire too high.

The pin 6 will be positioned a precise distance from the right side of the plate 2 (as seen in FIGS. 4–9). This will provide the proper distance at which the user will cut off the wire used in making the attachments. For example if a ⅜ inch spiral is being formed, as shown in FIGS. 4–7, the length of wire from pin 6 to the edge 12 of the right side of plate 2 will be ⅜ of a inch long. This will enable the user to cut the wire at the precise point to finish the clasp without measuring. Also, it should be noted that the dimensions of the clasps and other jewelry attachments made with the jig of the present invention may vary, and therefore, the dimensions given are for illustration purposes only. For example, in making a 1 inch component the distance between pins 5 and 7 would be 1 inch and the distance between pins 6 and 8 would be 5/16 of an inch. For a ¾ of an inch component the distance between pins 5 and 7 would be ¾ of an inch and the distance between pins 6 and 8 would be 5/16 of an inch. For a ½ inch component the distance between pins 5 and 7 would be ½ inch and the distance between pins 6 and 8 would be ¼ of an inch. Other sizes can be used and the above dimensions are merely examples.

Figure 11:
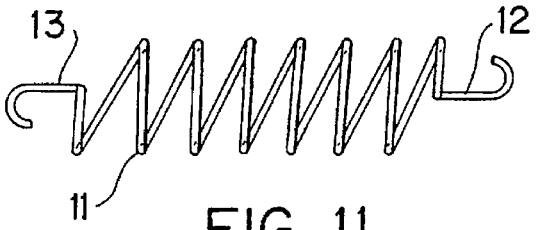
FIG. 11 is a view of the completed coil connector.

In FIG. 2 is shown a holding bar 9 which has an aperture 10 positioned closer to one end than the other end of the bar. The holding bar will be used, as will be explained below, in forming the wire 11 around the various pins. Also, the bar 9 can be used by itself to form coil type connectors, or findings or split ring connectors, as shown in FIGS. 10 and 11. In order to make a coil connector, the wire 11 is inserted into the aperture 10 in bar 9, then the wire is wrapped around the bar until the coil is the desired length. Then the excess wire is cut off. To remove the coil from the bar, the wire 11 is cut where the wire enters aperture 10, and the coil may be slid off the bar 9. Loops 12 and 13 may then be formed in the ends of the coils, using round nose pliers, and the coils would be used to secure the connector to other parts of the jewelry.

To make findings or split ring connectors, the individual coils would be cut at various positions after the coil is removed from the bar 9.

The method of using the jig 1 will now be described, however it should be understood that the types of connectors described are merely for illustration purposes, and are not meant to be an all inclusive list of the types of connectors that can be made with the jig of the present invention. Also, the pins 6 and 8 are show n oversized for clarity.

In using the jig to form a spiral connector, as shown in FIGS. 4–7, a length of wire, approximately 12 inches long is cut from a spool of wire. Round nose pliers, or a similar tool, may be used to form a loop in one end of the wire, and this loop will be placed on pin 8. The wire will then be passed around pin 5 and the bar 9 will be used to hold the wire against the surface of the plate 2, as shown in FIG. 5, while the wire is passed down and around the left side of pin 7. Next, the bar 9 will be moved, as shown in FIG. 6, to hold the wire while it is pulled around pin 7 and up toward pin 6. The wire will then be pulled over pin 6 and out to the right. Using the right edge 12 of the jig as a guide, the wire will be cut off. Since the distance between pin 6 and the edge of plate 2 is the exact distance necessary for a proper cut, it is not necessary to measure the wire. The wire can now be removed from the jig and round nose pliers used to form a loop 15 in the end similar to loop 14. Now the loops on the spiral clasp can be used to connect parts of jewelry together in order to form necklaces, bracelets or other jewelry items.

A zigzag connector is shown formed around the pins 5, 6, 7, and 8, in FIG. 8. In order to make the zigzag connector you would start in the same manner as the spiral connector, shown in FIGS. 4–7, until the wire is in the position shown in FIG. 5. Instead of passing the wire over pin 6, it would be passed around the left side of pin 7 and then up around the left side of pin 5, and back down around the left side of pin 7, in a figure-8 path. This step would be repeated until there are three or more loops around pins 5 and 7. Then the wire would be passed around pin 6 and cut off in the same manner as when the spiral connector was formed.

Figure 15:
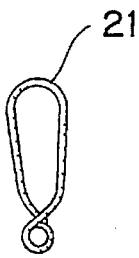
FIG. 15 is a view of the jewelry component of FIG. 9, which can be used as part of a clasp, after the loops are placed over one another.
Figure 16:
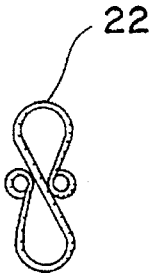
FIG. 16 is a view of the jewelry component made in FIGS. 4–7.

A clasp connector is shown being formed in FIG. 9. The clasp would be started the same way as the spiral connector, except the wire would not be passed under the pin 7 as shown in FIG. 5. Instead the wire would be passed over the top of pin 5 and then under pin 6 and out to the edge 12 of the plate 2 and then cut off. Loops 14 and 15 would be formed in the ends in the same manner as the example shown in FIGS. 4–7, the loops would then be superimposed over each other to form a single loop, as shown in FIG. 15, and can be stabilized by placing, for example, a piece of chain through the loops.

Figure 12:
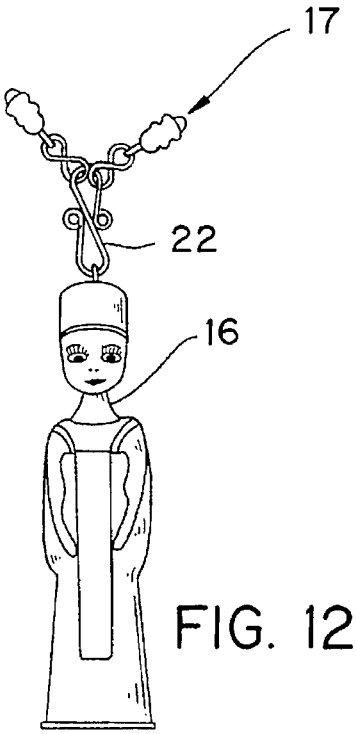
FIG. 12 is a view of the spiral clasp made in FIGS. 4–7 used to secure a pendant to a necklace.

FIG. 12 shows the spiral clasp 22 made in FIGS. 4–7, used to secure a pendant 16 to a necklace 17.

Figure 13:
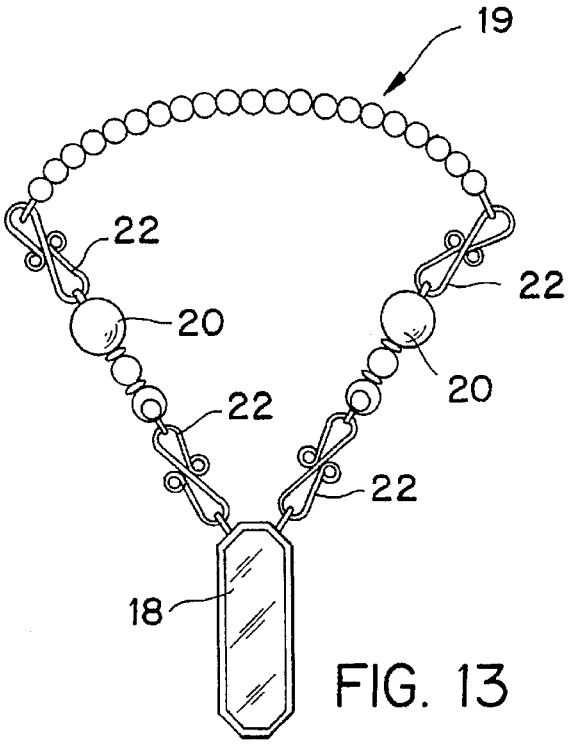
FIG. 13 is a view of the jewelry component made in FIGS. 4–7 used to secure a pendant to a necklace and to secure other parts of the necklace.
Figure 14:
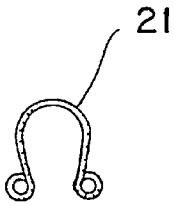
FIG. 14 is a view of the jewelry component of FIG. 9 before the loops are placed over one another.

FIG. 13 shows the spiral clasp 22 made in FIGS. 4–7, used to secure a pendant 18 to a necklace 19 and the same clasp is used to secure other parts such as beads 20 to the necklace.

It should be noted that even though only the spiral clasp is shown with parts of the necklace in FIGS. 12 and 13, the other connectors, such as the clasp 21, shown in FIGS. 8–10, 14 and 15 could be used in the same manner to make necklaces, bracelets, or other jewelry items.

Although the wire bending jig kit and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A wire bending jig kit used to form connectors used in making jewelry comprising:

a plate having ends, sides, a top surface and a bottom surface, said plate having means on said top surface, adjacent one end for attaching said plate to a work surface, four pins positioned on said top surface adjacent another end of said plate, said pins being spaced about an imaginary ellipse with each pin spaced approximately 90° from an adjacent pin, and a holding means for aiding in bending wire around said pins, at least one of said four pins being shorter than the remaining pins.

2. The wire bending jig kit as claimed in claim 1, wherein said pins are circular and at least two of said pins have smaller diameters than another two of said pins.

3. The wire bending jig kit as claimed in claim 1, wherein said holding means is a separate holding means for holding wire against said top surface of said flat plate as said wire is bent around said pins.

4. The wire bending jig kit as claimed in claim 3, wherein said separate holding means consists of a bar having an aperture adjacent one end.

5. The wire bending jig kit as claimed in claim 1, wherein said plate has a measuring indicia means for measuring a specific length of wire so that said wire may be cut off at a specific point, said measuring indicia means consists of one of said pins being spaced a specific distance from a side of said plate, said specific distance being equal to a circumference of said pin.

6. A method of using a wire bending jig kit for use in making jewelry, said method utilizing a bar having an aperture adjacent one end, said method comprising passing an end of said wire through said aperture in said circular bar, wrapping said wire around said circular bar a plurality of turns to form a coiled connector having a plurality of coils, cutting said wire at a point furthest from said aperture in said circular bar, cutting said wire at a point closest to said aperture in said circular bar, sliding said coiled connector off said circular bar, cutting said coiled connector at each of said plurality of coils to form split ring connectors.

7. A method of using a wire bending jig kit for use in making jewelry, said method utilizing a bar and a plate, said plate having ends, sides, a top surface and a bottom surface, said plate having means on said top surface, adjacent one end for attaching said plate to a work surface, said plate having four pins positioned on said top surface adjacent another end of said plate, said pins being spaced about an imaginary ellipse with each pin spaced approximately 90° from an adjacent pin, said method comprising:

placing one of said pins a distance from an edge of said plate that is equal to a circumference of said pin, forming a loop in an end of said wire, placing said loop on the pin positioned at the 270° position on said imaginary ellipse, passing said wire around a pin positioned at the 0° position on said imaginary ellipse, passing said wire around a pin positioned at the 90° position on said imaginary ellipse, moving said wire to said edge of said flat plate, cutting said wire at the point where said wire crosses said edge of said flat plate, and forming a loop in said cut end of said wire.

8. The method of using a wire bending jig kit for use in making jewelry as claimed in claim 7, which includes the step of placing said bar over said wire between said pin positioned at the 270° position and said pin positioned at the 0° position and pressing said wire against said top surface of said flat plate, to aid in wrapping said wire around said pins.

9. The method as claimed in claim 7, further comprising:

moving said loops so one of the loops overlies another loop, securing said loops together.

10. A method of using a wire bending jig kit for use in making jewelry, said method utilizing a bar and a plate, said plate having ends, sides, a top surface and a bottom surface, said plate having means on said top surface, adjacent one end for attaching said plate to a work surface, said plate having four pins positioned on said top surface adjacent another end of said plate, said pins being spaced about an imaginary ellipse with each pin spaced approximately 90° from an adjacent pin, said method comprising:

placing one of said pins a distance from an edge of said plate that is equal to a circumference of said pin, forming a loop in an end of said wire, placing said loop on the pin positioned at the 270° position on said imaginary ellipse, passing said wire around a pin positioned at the 0° position on said imaginary ellipse, passing said wire around a pin positioned at the 180° position on said imaginary ellipse, passing said wire around a pin positioned at the 90° position on said imaginary ellipse, moving said wire to said edge of said plate, cutting said wire at the point where said wire crosses said edge of said plate, and forming a loop in said cut end of said wire.

11. The method of using a wire bending jig kit for use in making jewelry as claimed in claim 10, which includes the step of placing said circular bar over said wire between said pin positioned at the 270° position and said pin positioned at the 0° position and pressing said wire against said top surface of said flat plate, to aid in wrapping said wire around said pins, and after said wire is passed around the pin positioned at the 180° position on said imaginary ellipse, placing said bar over said wire between said pin positioned at the 180° position and said pin positioned at the 90° position and pressing said wire against said top surface of said plate.

12. A method of using a wire bending jig kit for use in making jewelry, said method utilizing a bar and a plate, said plate having ends, sides, a top surface and a bottom surface, said plate having means on said top surface, adjacent one end for attaching said plate to a work surface, said plate having four pins positioned on said top surface adjacent another end of said plate, said pins being spaced about an imaginary ellipse with each pin spaced approximately 90° from an adjacent pin, said method comprising:

placing one of said pins a distance from an edge of said plate that is equal to a circumference of said pin, A) forming a loop in an end of said wire, B) placing said loop on said pin positioned at the 270° position on said imaginary ellipse, C) passing said wire around a pin positioned at the 0° position on said imaginary ellipse, D) passing said wire around a pin positioned at the 180° position on said imaginary ellipse, E) repeating steps C and D at least two more times, then F) passing said wire around the pin positioned at the 90° position on said imaginary ellipse, G) moving said wire to said edge of said plate, H) cutting said wire at the point where said wire crosses said edge of said plate, and I) forming a loop in said cut end of said wire.

13. The method as claimed in claim 12, further comprising:

performing the following step between step C and step D, placing said bar over said wire between said pin positioned at the 270° position and said pin positioned at the 0° position and pressing said wire against said top surface of said plate in order to hold the wire while it is being wrapped around said pins, and performing the following step between step E and step F, placing said bar over said wire between said pin positioned at the 180° position and said pin positioned at the 90° position and pressing said wire against said top surface of said plate in order to hold the wire while it is being wrapped around said pins.

* * * * *